US005467793A

United States Patent [19]

Hart

[11] Patent Number: 5,467,793

[45] Date of Patent: Nov. 21, 1995

[54] ORTHOTIC WALKER

[75] Inventor: David Hart, Keighley, England

[73] Assignee: Ontario Crippled Children's Centre, Toronto, Canada

[21] Appl. No.: 330,832

[22] Filed: Oct. 27, 1994

[51] Int. Cl.[6] ..... A61H 3/00

[52] U.S. Cl. ..... 135/67; 135/66; 135/912; 280/87.021; 297/5

[58] Field of Search ..... 135/65, 66, 67, 135/DIG. 912; 280/87.01, 87.021, 87.014; 297/5

[56] References Cited

U.S. PATENT DOCUMENTS

| | | | |
|---|---|---|---|
| 3,778,052 | 12/1973 | Andow et al. | 280/87.041 |
| 4,111,445 | 9/1978 | Haibeck | 297/5 X |
| 4,770,410 | 9/1988 | Brown | 135/67 X |
| 4,813,664 | 3/1989 | Vroulis | 280/87.021 X |
| 4,890,853 | 1/1990 | Olson | 280/87.021 |
| 5,255,697 | 10/1993 | Grauer | 297/5 X |
| 5,275,426 | 1/1994 | Tankersley | 135/67 X |
| 5,340,139 | 8/1994 | Davis | 297/5 X |
| 5,364,120 | 11/1994 | Shimansky | 280/87.041 X |
| 5,411,044 | 5/1995 | Andolfi | 135/60 |

*Primary Examiner*—Wynn E. Wood
*Attorney, Agent, or Firm*—Jane Parsons

[57] ABSTRACT

In an orthotic walker, mechanism is provided to bias alternate motion of a user's legs. The mechanism may be a reciprocating bar at hip level, or at least one strap ends of which are attached to leg braces and the bight passing round a fixed frame member. A stirrup mechanism may be pivoted at an "ankle joint" and the pivotal motion may be limited to avoid toe down position. The stirrup may have a clamp for a shoe. Brake mechanism may be movable between operative and inoperative positions. In the operative position rearward rolling is disallowed while forward motion is allowed.

10 Claims, 7 Drawing Sheets

ORTHOTIC WALKER

BACKGROUND OF THE INVENTION

1. Field of the Invention

This invention relates to an orthosis to provide adjustable support and control to a patient suffering from cerebral palsy or of a similar medical condition, allowing the patient to stand and walk, 2. Description of the Prior Art There is no known cure for cerebral palsy. Therefore, treatment for the condition is aimed at helping the patient make best use of his or her physical abilities. For many people with cerebral palsy, there are available braces and other devices that can provide that degree of support which will enable the person to walk., but for many, the severity of their condition prevents them from even attaining a standing position.

British Patent No. 2,231,500 issued to David Hart, who is also the inventor of this invention, discloses a walking support orthosis intended for those people having disabilities which may not be so severe that they would normally be unable to even attain standing position. The orthosis of said British Patent No. 2,231,500 comprises a wheeled frame, support mechanism, a body brace means for releasably securing the body brace to support mechanism, means for patient to control steering of wheeled frame, means for adjusting amount of lifting support to the patient, means for automatically braking the rear floor wheels in the event of the patient failing to maintain an upright posture.

The body brace of said British Patent 2,231,500 holds the body of the user fixed in position in relation to the support. No provision has been made for the normal leg swinging that is normal in walking. Such leg swinging is normal in walking in able bodied persons and therefore desirable to mimic in an orthosis. It would also be desirable to accentuate this action in an orthosis in order, inter alia, to provide follow through impetus to the user to take the next step.

Further desirable features in an orthosis of the type described and claimed in said British Patent would be the provision of foot manipulation means to discourage a toe-down stance in the user, shoe clamping means which is easily operable while providing a firm grip on the shoe. Also, importantly, an automatic brake to guard against undesirable uncontrolled rearward movement would be desirable. Such brakes should, of course, be disengageable when rearward movement is desired.

The present invention has addressed these concerns and has devised improvements to the orthosis which is the subject of this British Patent No. 2,231,500.

SUMMARY OF THE INVENTION

According to the invention there is provided a walking support orthosis comprising:

a wheeled frame and a support member for a body brace, the support member being located to extend at least partially behind the body of a user;

a body brace including leg braces having support engagement means to engage said support, the engagement means being located on a rear part of the body brace, and the leg braces having generally hip level pivotal connections to said support member to allow articulation of the hip joint of the user;

reciprocating bar mechanism to bias opposite action of legs of a user at generally hip level, the bar mechanism comprising;

a generally horizontal reciprocable bar behind the body brace pivoted to the frame for reciprocating movement so that ends of said reciprocable bar move alternatively forwards and rearwards;

upward extensions of said leg braces extending upwardly of said pivotal connections, and links between each of said ends of the reciprocable bar with respective ones of said upward extensions whereby movement of one leg of a user in one direction reciprocates said reciprocable bar to bias the other leg of the user in the opposite direction.

Each of said links may comprise a bar pivoted at one end to one of said ends of the reciprocable bar and at the other end to one of said upward extension of said leg braces. The links may be straight bars either horizontal or tilted or they have a bend to adjust for any difference in height between the reciprocable bar and the upward extensions or the leg braces.

The height of the upward extensions has appreciable influence on the action of the reciprocable bar. The higher the extensions, the greater the travel of the ends of the reciprocable bar and the greater the effect on the user. The height of the upward extensions must, therefore, be chosen according to the effect desired.

The length of each of the links is adjustable to allow for differences in front to rear distance according to the user. The length of the reciprocable bar may also be adjustable to allow for different side to side widths of the user.

Also according to the invention there is provided a walking support orthosis comprising:

a wheeled frame a support member for a body brace, the support member being located to extend at least partially behind the body of a user;

a body brace including leg braces, and having support engagement means to engage said support, the engagement means being located on a rear part of the body brace, and the leg braces having generally hip-level pivotal connections to said support member to allow articulation of a hip joint of a user;

a reciprocating strap mechanism to bias opposite action of legs of a user, the said strap mechanism comprising a strap connected at each end to respective ones of said leg braces, a bight of the strap extending between the ends about a fixed part of said frame forward or rearward of the leg braces and distanced therefrom by approximately half the length of the strap.

The strap mechanism may comprise a rear strap having a rearwardly extending bight which passes around a post upstanding from a rear lower frame member. Each end of the strap may be attached to a thigh member of the leg brace.

Alternatively or additionally the strap mechanism may comprise a front strap having a forwardly extending bight which passes round a forward lower frame member. Each end of the front strap is attached to the leg brace through attachments on a lower part of the leg brace. When all of the reciprocable bar and a rear strap and a forward strap are all present, impetus may be given to the legs of a user at hip level, thigh level and shoe level, thus providing balanced strong impetus.

Also according to the invention there is provided a walking support orthosis comprising:

a wheeled frame;

a support member for a body brace, the support member being located to extend at least partially behind the body of a user;

a body brace including leg braces, and having support engagement means to engage said support, the engagement means being located on a rear part of the body brace, and the leg braces having generally hip level connections to the support member to allow for articulation of a hip joint of a user;

each leg brace including:

a stirrup for supporting the foot of a user, the stirrup means comprising a generally horizontal support bar located to lie under the instep of a user and a stirrup leg fixed to the support bar at one leg end extending rearwardly upwardly, for example at 60 degrees, from the support bar to a pivotal connection with a lower end of a shank member of the leg brace;

a stop being provided to limit pivotal travel of the stirrup leg.

A clamp may be provided to clamp a shoe of the user to be fixed against swivelling on the support bar of the stirrup. The clamp may serve another function in that it may hold the shoe firmly on the support bar and prevent it swivelling on the support bar.

The stop may comprise a lug projecting from a rearward upward extension of the stirrup leg. The lug may abut a lower portion of said shank member to limit said pivotal travel of the stirrup leg beyond a preset limit.

The lug includes an enlarged portion to abut said shank member, whereby the limit of said pivotal travel is set according to the size of the enlarged portion. The enlarged portion may be an adjustable cam whereby the limit of said pivotal travel is adjustable.

The invention also includes a walking support orthosis comprising:

a wheeled frame;

a support member for a body brace, the support member being located to extend at least partially behind the body of a user;

a body brace including leg braces, and having support engagement means to engage said support, the engagement means being located on a rear part of the body brace, and the leg braces having generally hip level connections to the support member to allow for articulation of a hip joint of a user;

a brake mechanism being settable to an inoperative condition and into an operative condition, whereby, in the inoperative condition, no braking against rearward movement is applied, and, in the operative condition, automatic braking against rearward braking is applied while forward movement is unbraked. The brake mechanism may be located on a side lower frame member extending forwardly of a rear wheel of the wheeled frame, a brake block is attached to said side lower frame member to be movable between a forward inoperative position and a rear operative position in which it bears on said wheel when said wheel is rotated into a position for rearward rolling and in which said wheel is clear of the brake block when it is rotated into position for forward rolling. Preferably the brake mechanism is located on each of two side lower frame members.

Each brake block may be attached to said side lower frame member through a resiliently expansible strap whereby the strap is manually expansible to allow movement of the block between its operative and inoperative positions.

BRIEF DESCRIPTION OF THE DRAWINGS

For a better understanding of the present invention, reference will now be made by way of example to the accompanying drawings in which.

DETAILED DESCRIPTION OF THE DRAWINGS

Figure 1:
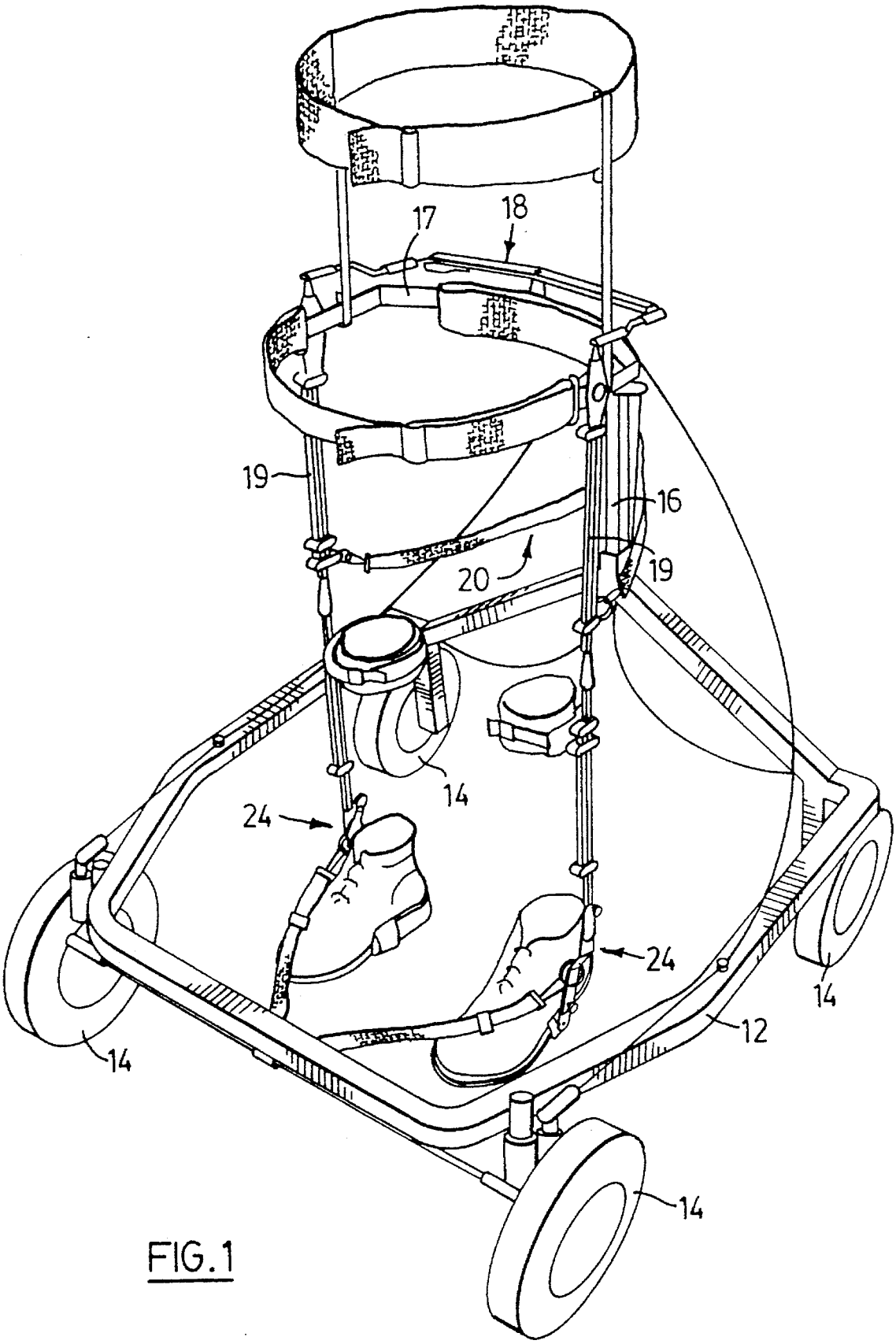
FIG. 1 shows a patient using a support orthosis according to the invention.

The illustrated walking support orthosis of the drawings comprises a frame 12 having a lower frame portion comprising a front horizontal member 12A, side members 12B and a rear member 12C and four wheels 14. The frame members may be, for example, square or round section steel tube and may be telescopic for adjustment of size. A rear portion of the frame 12 extends upwardly to provide a support member 16 for a body brace 17 which includes leg braces 19. The height of support 16 may be adjustable by any convenient means, for example, those illustrated in the aforementioned British Patent 2,231,500 but it should be generally in the mid-region of the body. Possibly a generally horizontal support member 16 may be around hip level and an upstanding support hook 19 for the body brace 17 may be of adjustable height above the support member 11. The device includes reciprocating bar mechanism 18, shown in detail in FIG. 2 to help the user swing his legs alternately. The device also includes a reciprocating strap mechanism 20, shown in more detail in FIG. 3, to supplement the reciprocating bar mechanism by providing follow through movement to the user's legs. The device also includes foot orientation mechanism 24 and a shoe clamp 26, shown in more detail in FIG. 5, to discourage the tendency of users to have their feet in a position with the toes pointing unnaturally downwards. A brake 28, shown more fully in FIGS. 6A and 6B, is provided which may be set in one position to automatically engage against rearward motion. Alternatively the brake 28 may be set so that rearward movement is allowed.

Figure 2:
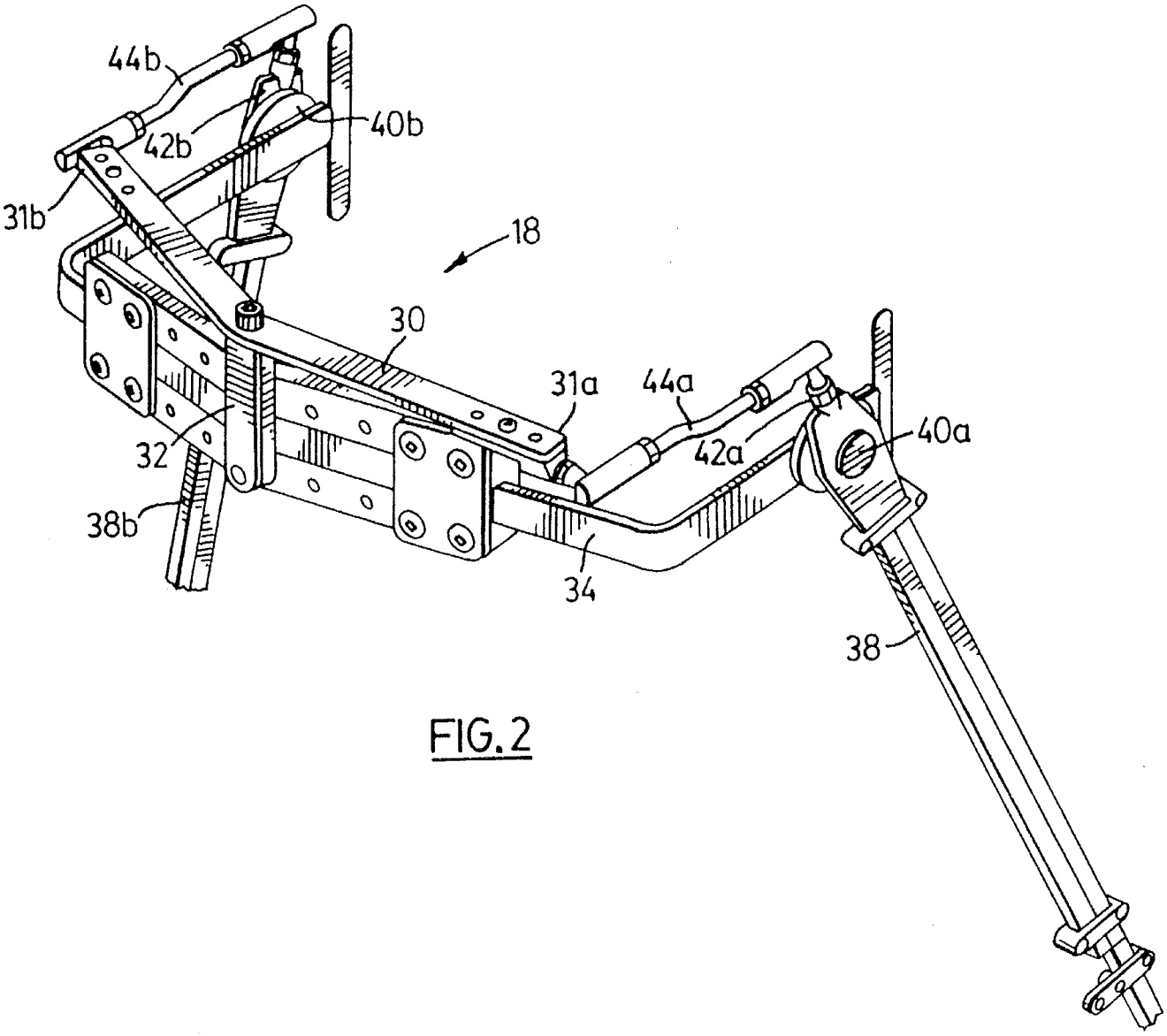
FIG. 2 illustrates part of an orthosis such as that of FIG. 1 and having a reciprocating mechanism to provide limb swinging.

FIG. 2 shows a view of the reciprocating bar mechanism 18 from the rear in the region of a horizontal U-shaped frame member 34 of the support 16. The frame member 34 is pivoted at each end 35*a*, 35*b* to the respective thigh members 38*a*, 38*b* of the leg braces of the orthotic device. Each thigh member 38*a*, 38*b* has a short extension 42*a*, 42*b*, upward of its respective pivot point 40*a*, 40*b* with the respective frame member end 35*a*, 35*b* of the support 16. A generally horizontal, reciprocable bar 30 is located above and slightly behind the frame member 34 and is pivoted to it through a vertical pivot 32 so that it may pivot in a generally horizontal plane. The reciprocable bar 30 is connected to the upper ends of the thigh member extensions 42*a*, 42*b* through links 44*a*, 44*b*. Each link 44*a*, 44*b* is pivoted at one end to the reciprocable bar 30 and at the other end to the respective thigh member extension 42*a*, 42*b* so that the link extends forwardly from the reciprocable bar 30 to the respective thigh member extension 42*a*, 42*b*. Each link may be generally horizontal or may be tilted to allow for a difference in height between the level of the respective end of reciprocable bar 30 and the top of the respective thigh member extension 42*a*, 42*b*. Alternatively or additionally, as shown, the pivot arm may have a bend to allow for this difference of level or to extend the link about the user's hips. The pivot arms 44*a*, 44*b* may, themselves, be extensible to allow for adjustment in the distance between the respective end of reciprocable bar 30 and the respective thigh extension member 42*a*, 42*b*.

In use, when the leg of a user is moved forward in walking step, the thigh member 38*a* pivots at pivot 40*a* on the frame member 34. Thus, the lower end of thigh member 38*a*, which corresponds roughly to the user's knee moves forwardly and the top end of extension member 42*a* moves slightly rearwardly. The rearward movement of the top of extension member 42*a* pushes pivot arm 44*a* rearwardly to push the respective first end 35*a* of reciprocable bar 30 rearwardly also. This causes reciprocable bar 30 to pivot on pivot 32 to move its other end 35*b* forwardly. Forward movement of end 35*b* pushes on the pivot arm 44*b*. This other pivot arm 44*b* cannot move forwardly until there is movement in the other thigh member brace 38*b*. In order to allow forward movement of pivot member 44*b*, the lower part of thigh member 38*b* must move rearwardly to pivot it on pivot 40*b* so that the top of its extension member 42*b* moves forwardly with pivot arm 44*b*.

Thus, movement of the leg of a user so that thigh member 38*a* moves forwardly at its lower end exerts appreciable force on the hips of the user to bias the opposing hip to swing the opposing leg rearwardly.

Figure 3A:
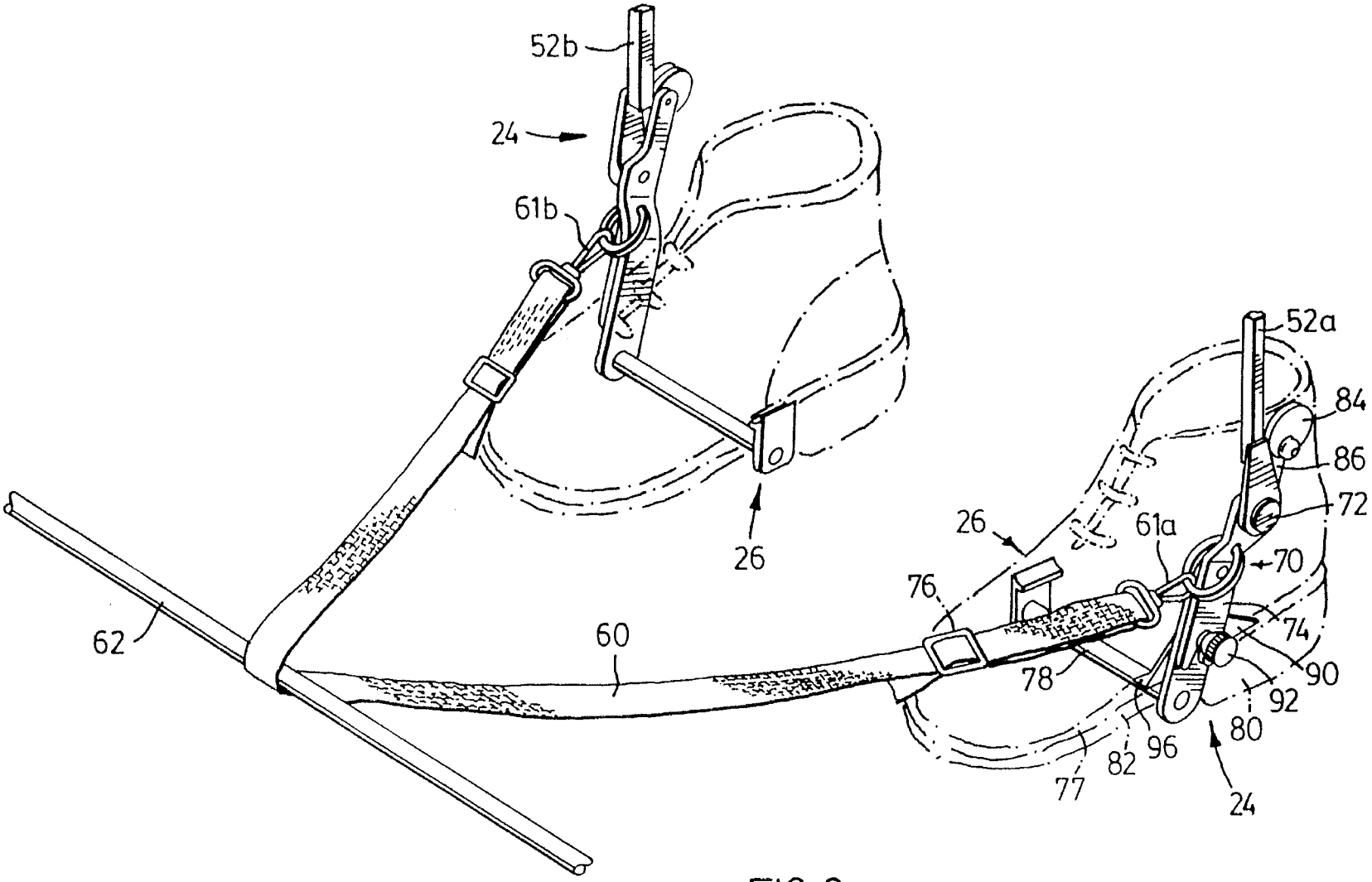
FIGS. 3A and 3B illustrate apparatus to provide follow through impetus to the legs.
Figure 3B:
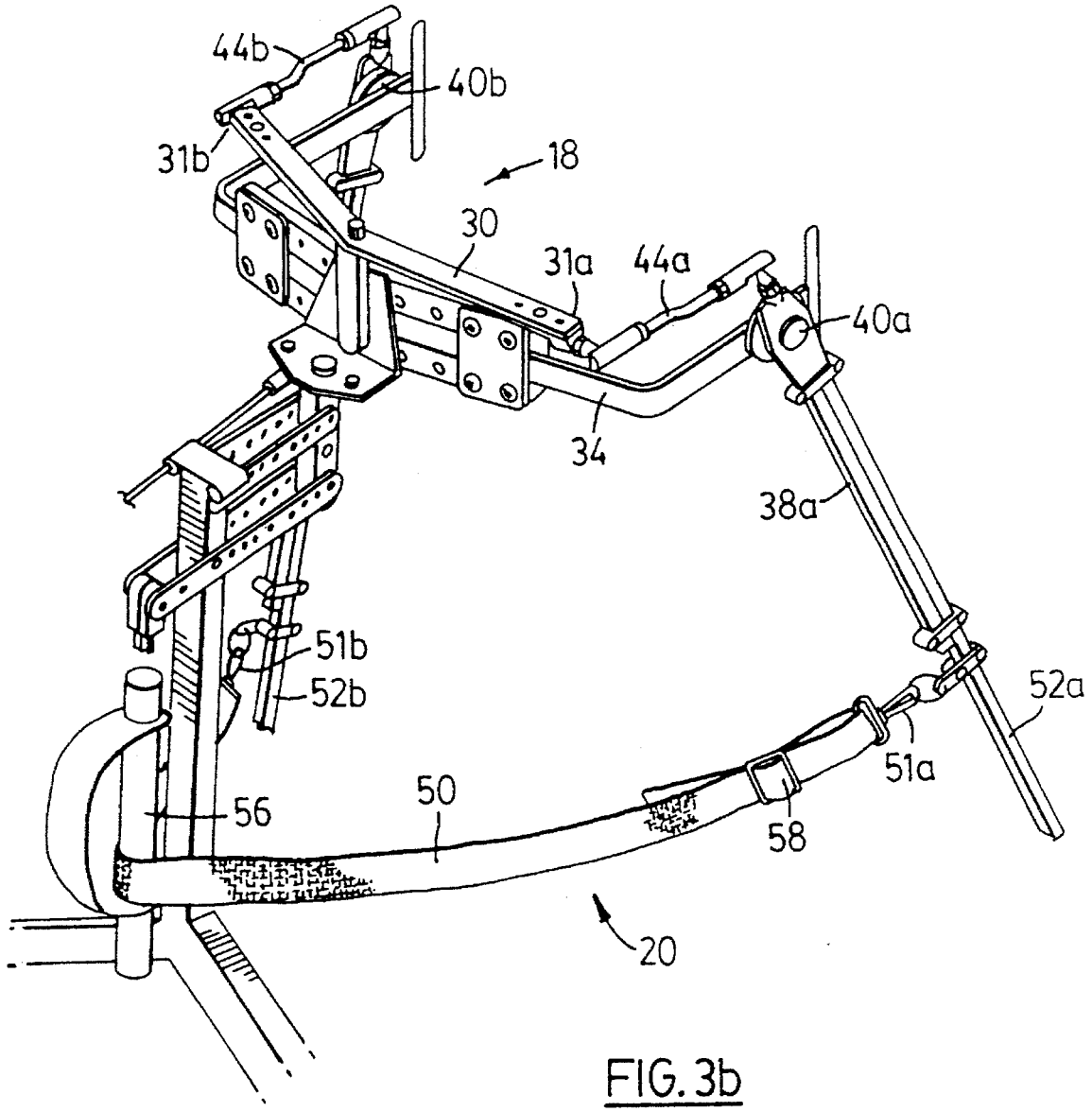

The encouragement to leg swinging given by the action of the reciprocable bar 30 may be enhanced by the strap mechanism of FIG. 3 which acts directly on the legs of the user. The strap mechanism 20 of FIG. 3 may be utilized on an orthosis which is provided or which is not provided with the reciprocable bar mechanism described above. When the reciprocable bar mechanism is present the strap mechanism 20 provides enhancement but when the reciprocable bar mechanism is not present the strap mechanism may provide the sole impetus for moving the legs alternately.

The strap mechanism 20 comprises a strap 50 and/or a strap 52. The strap 50 is attached at each end to a lower part of the leg brace. For example, each end 51*a*, 51*b*, of strap 50 may be attached to a lower part of thigh member 38*a*, 38*b* of the leg brace. Shank members 52*a* and 52*b* are connected respectively below thigh members 38*a* and 38*b* through a pivoting joint 54*a*, 54*b* which, for verbal illustration, will be referred to as a "knee joint". The knee joint is free motion.

The strap 50 extends rearwardly from the leg braces to extend around a post 56 extending upwardly from the rear part of the main frame. Post 56 may be provided with a slot 55 or other restraining means to maintain the bight of strap 50 within a confined vertical region of the post 56 which may have a rotating sleeve to promote easy movement of the strap around the post. The ends 51*a* and 51*b* may be releasably attached to the thigh members 38*a* and 38*b* through any suitable quick release means such as a quick release snap having a manually withdrawable latch. The snaps may be attached to the strap 50 through a swivel.

In use, when the thigh portion 38*a* of the user is moved forwardly the thigh portion 38*b* is forced rearwardly as the bight of the strap 50 travels around the post 56. The strap 50 may be provided with an adjustment buckle 58 both for the purpose of adjusting to different user sizes and also to vary its effect. A shorter strap will cause a shorter step size. The strap may be made of any material sufficiently strong to stand up to the pressure to cause one leg to be forced to move in a direction opposite to the other. Webbing made from nylon or polypropylene is very suitable but cotton webbing or other material may also be used.

Strap 60 may be used to supplement the action of strap 50 or to replace it. The action of strap 60 is very similar to that of strap 50 but the bight of the strap passes forwardly around a forward horizontal frame member 12A and the ends 61*a* and 61*b* are attached to the stirrup 70. Strap 60, like strap 50, may be provided with adjustment means and any convenient means may be used.

Figure 4C:
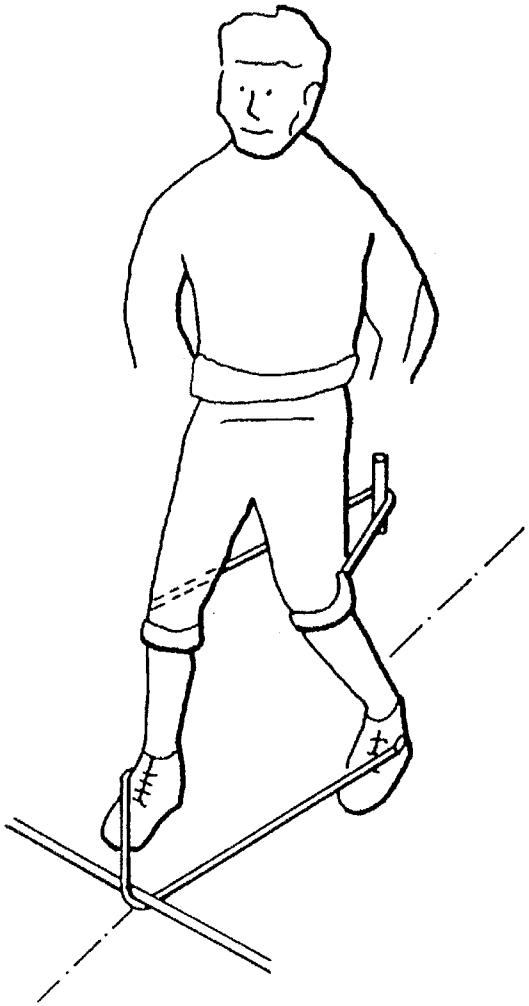
FIGS. 4A, 4B, 4C, etc. are simplistic sketches showing the effect of the apparatus of FIGS. 3A and 3B on a user.
Figure 4B:
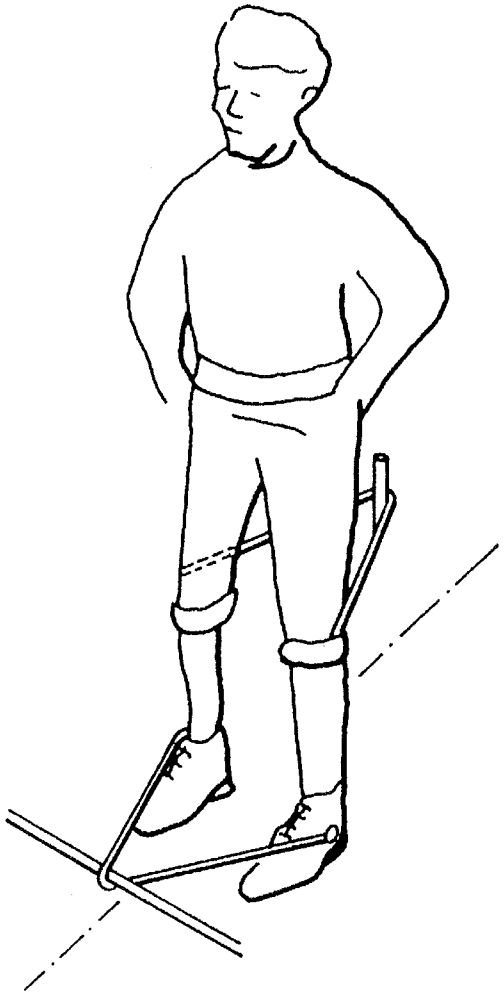
Figure 4A:
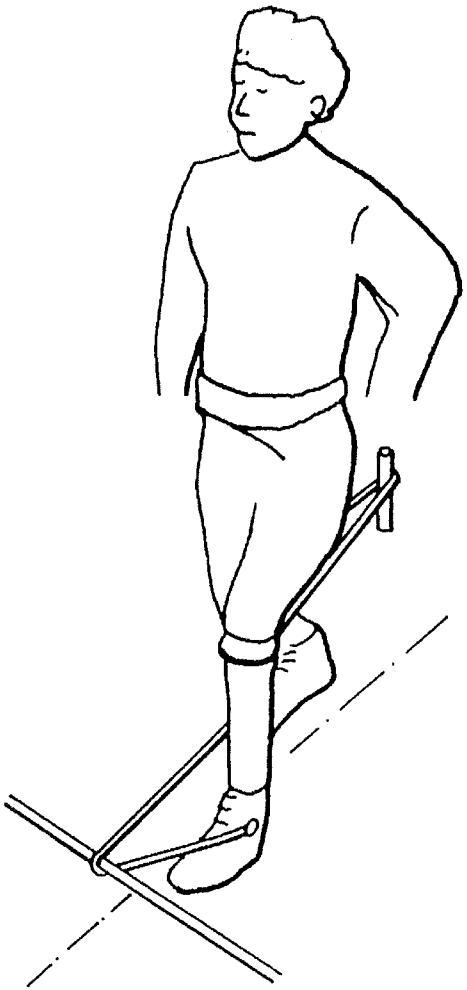

When all of the reciprocable bar 30, the strap 50 and the strap 60 are all provided, considerable impetus in alternate leg movement may be provided at different points along of the length of the leg. This may be demonstrated by the sketches of FIGS. 4A, 4B and 4C.

Since strap 60 has its bight around a horizontal member, it may vary in its position along the length of the horizontal member according to the direction in which the user is facing. Thus if the user is angled to the left then the bight of strap 60 will tend to be towards one end of the horizontal member 62 which may have a rotatable sleeve to promote easy movement of the strap therearound. If the user is angled towards the right the bight will tend to be towards the other end. Thus the effect of strap 60 will be similar irrespective of the direction in which the user is facing.

Figure 5:
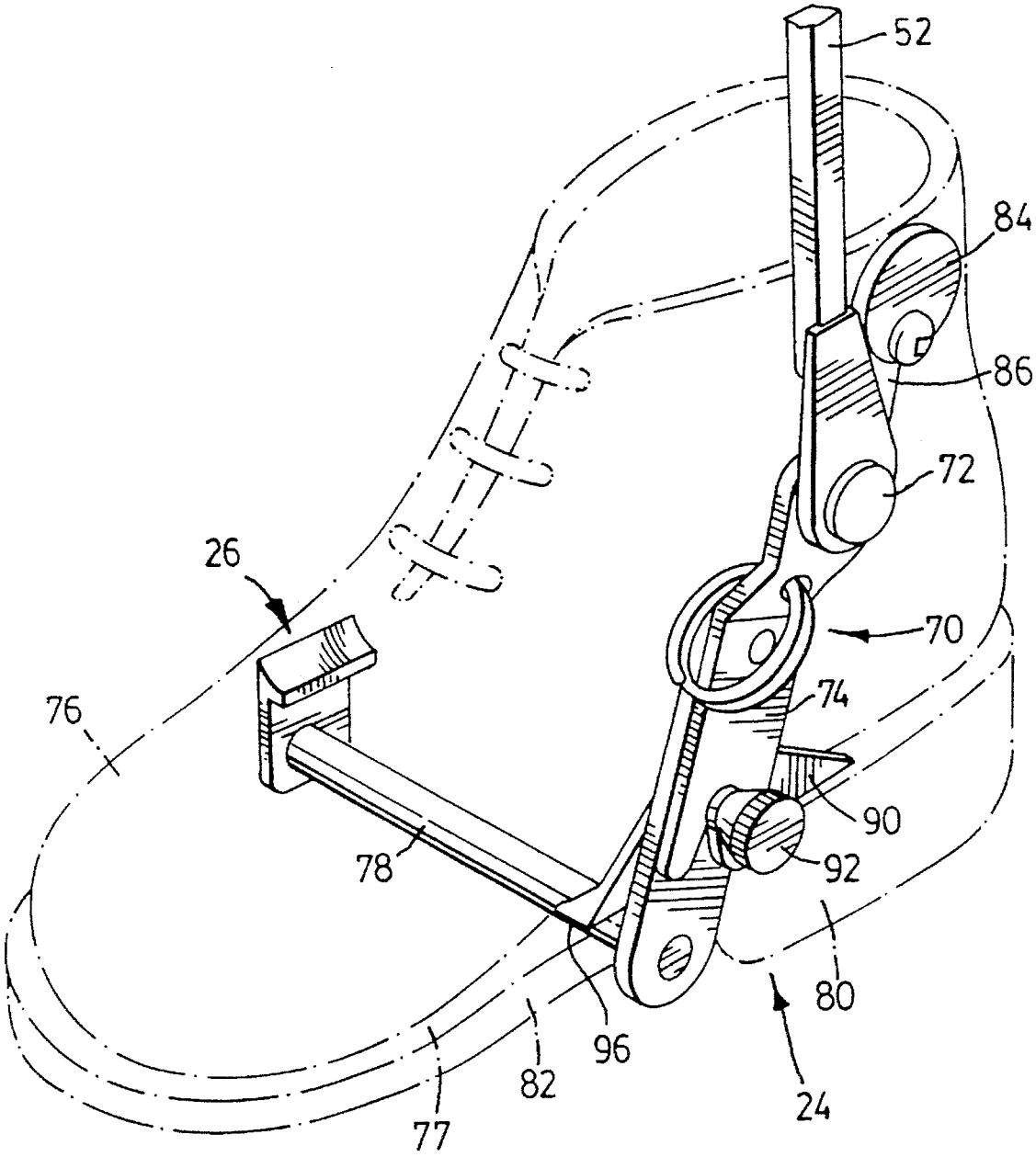
FIG. 5 illustrates a mechanism for discouraging toe-down orientation of a user's foot and a shoe clamping mechanism.
Figure 6:
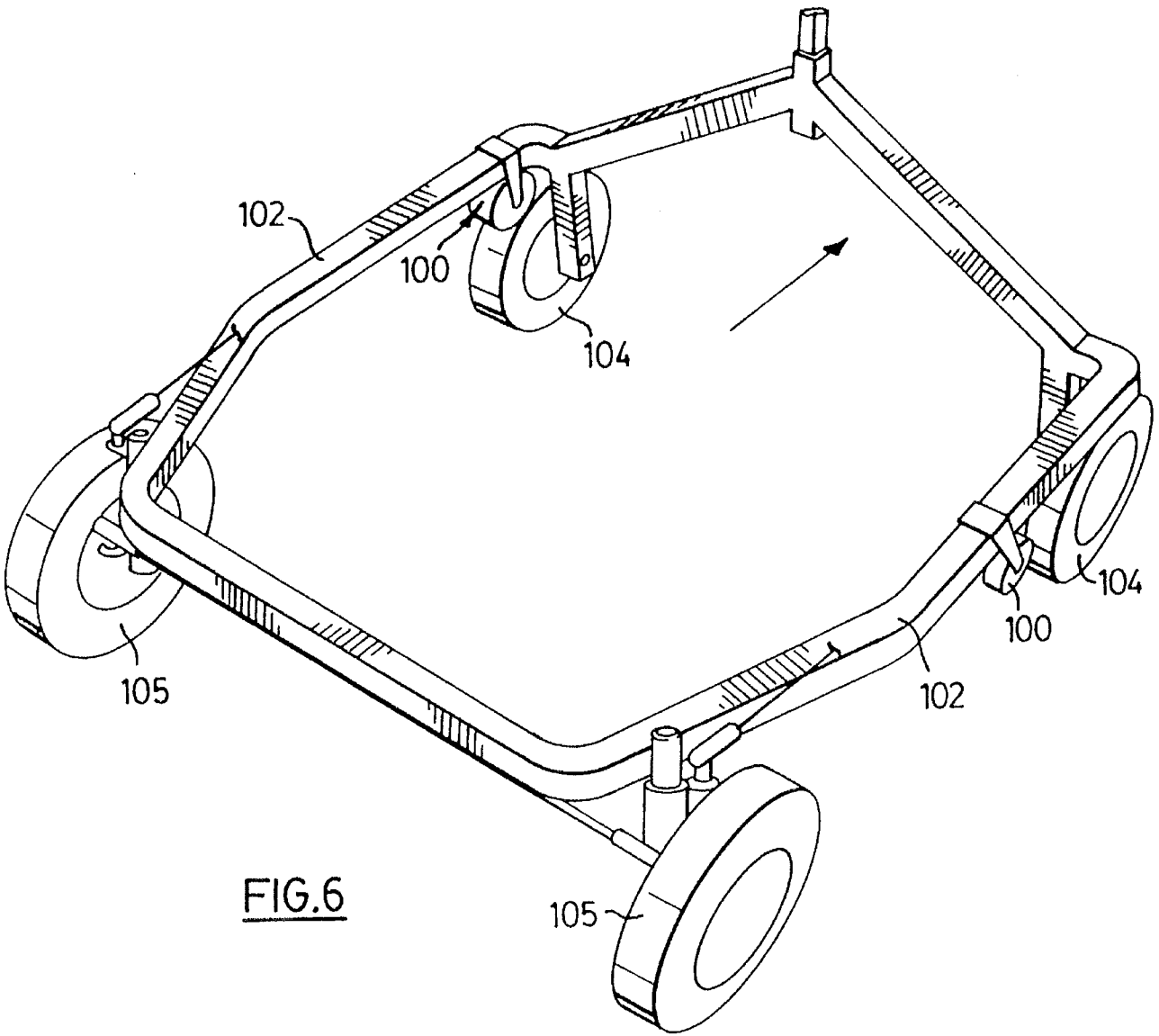
FIG. 6 illustrates an automatic disengageable brake against rearward movement.

FIG. 5 and 6 illustrate the mechanism 24 for inhibiting the natural tendency of some non-ambulatory users to take up a toe-down position and the shoe clamping mechanism 26.

FIG. 5 shows the lower end of shank member 52 of the leg brace pivoted at pivot 72 to outer leg 74 of stirrup 70 for shoe 76. The pivot 72 mimics the ankle joint of the user.

The stirrup 70, itself, is generally L-shaped. One leg of the L is the outer upstanding leg 74 and the support bar is a horizontal member 78 extending under the shoe 76 in the groove between heel 80 and sole 82. It is not necessary to form the stirrup as a U-shaped member having an inner leg. Indeed, the absence of an inner leg may have significant advantages in that inwardly projecting parts of adjacent inner legs will not foul each other when they are not present but, when they are present, there may be a significant risk of entanglement. Nevertheless, the presence of an inner leg is not positively excluded.

The upstanding stirrup leg 74 projects upwardly and rearwardly from its lower end connected with support bar 78 in the groove between the heel 80 and the sole 82 of the shoe to the pivot 72. The angle of the leg 74 to the horizontal is about 60 degrees. In the position shown in FIG. 5 the shoe is held in balanced horizontal position on support bar 78. If leg 74 rotates on pivot 72 in an anticlockwise direction, support bar 78 will tend to raise the toe of the shoe as the lower end of leg 74 rises toward the horizontal. If, on the other hand, it were possible for leg 74 to rotate in a clockwise direction on pivot 72 the toe of the shoe would drop until the leg 74 became vertical. This clockwise movement is prevented by the provision of an outwardly projecting lug 84 on a rearward extension 86 of leg 74. Rearward extension 86 is axially aligned with leg 74 and integral with it. Lug 84 projects from it to abut the lower part of shank member 52 to prevent clockwise rotation of leg 74 beyond a predetermined angle in which shoe 76 is held horizontal.

In order to inhibit swivelling of the user's foot or support bar 78, the shoe 76 should be clamped in position with respect to it. Convenient clamping may be carried out as described hereafter.

The force of a user's toe-down inclination may be appreciable and therefore, the length of rearward extension 86 and the location of lug 84 should be such that sufficient leverage is exerted to hold the shoe horizontal. When the length of extension 86 is significant, it will be necessary to make lug 84 of sufficient diameter as to maintain the angle of leg 74 to maintain the shoe horizontal. The diameter may either be increased over the whole length of lug 84 or an enlarged boss 88 may be provided to bear against shank member 52 of the leg brace. The length of the rearward extension 86 and the diameter of leg 84 are interdependent but their choices will be easily apparent.

The angle of leg 74 to the horizontal plane of the sole of the shoe may suitably in the region of 60 degrees. This angle, however, is a matter of choice. The steeper the angle, i.e. the more nearly vertical is leg 74, the less influence it has in holding the toe of the shoe up. If, on the other hand, the angle of leg 74 is much shallower i.e. its lower end projects much further forward, problems may be encountered in locating the horizontal leg 78 in the groove between the heel and the sole of the shoe and there may be difficulties in sizing lug 84 to abut shank member 52 to maintain leg 74 at its set angle against clockwise rotation. When an orthopaedic shoe is utilized in the groove between heel and sole may be, to an extent, located according to choice to allow for a particular angle of stirrup leg 74. Nevertheless, for at least aesthetic reasons the groove between heel and sole should be located conventionally.

When lug 84 is provided with an enlarged boss 88 to bear against the lower part of shank member 52, it may be convenient, in certain circumstances, to allow a greater toe-down orientation. Thus, boss 88 may be a cam pivotable on lug 84 so that it can be moved into a position where no clockwise movement of leg 74 is permitted, i.e. no toe-down orientation allowed (see FIG. 5A). Alternatively it may be pivoted out of contact with shank member 52 so that some toe-down movement is allowed (see FIG. 5B).

The stirrup 70 provides a base for the clamping arrangement 26 which may give a firm clamp to the user's shoe without the need of multiple straps and awkward fastenings.

The leg 74 is a two part leg having an upper part 73 and a detachable lower part 75. The lower part 75 carries the support bar 78 and is connected to the upper part 73 to be rigid with it in use. A hook 79 is provided at the inner end of support bar 78 to hook over a projecting edge of sole 82 of shoe 76. A clamp 90 is connected to act at the outer edge of shoe 76 to clamp the projecting edge of the sole 82 at that point and to press the shoe firmly against hook 79. The clamping bar 90 is provided with a lower edge 96 adapted to clamp firmly against the top seam between the upper of shoe 76 and the base. Screw 92 may be tightened through upper and lower parts of leg 74 to bias the clamp 90 against the shoe and to bias the shoe against hook 79. Loosening the screw loosens clamp 90. Thus when the clamping bar is located in the position shown in FIG. 6, the base 77 of the shoe 76 is held firmly between the support leg 78 of stirrup 70 and the clamping bar 90.

The lower part 75 of the leg 74 has a slotted upper end which engages a lug on the upper part of the leg and the upper part 73 of the leg has a lower slotted end which engages screw 92. Thus, depending on the length of the slots the leg 74 may be lengthened or shortened. Screw 92 not only tightens the clamp 90 but also holds the upper and lower parts 73, 75 firmly together.

FIG. 6 illustrates the brake 28 on side rail 12B$^{1}$ in inoperative position. FIG. 6 illustrates the brake 28 on side rail 12B$^{11}$ in operative position. The orthosis is attempting to move rearwardly in the direction of arrow A and the brake 28 is engaged.

The brake mechanism 28 comprises brake blocks 100 mounted on respective lower side frame members 12B which extend from front to rear of the frame of the orthosis. The side lower frame members 102 of the orthosis have, at their rear ends, wheels 104.

When it is desired to move brake block into a position where it automatically brakes the orthosis against rearward rolling, the brake block is moved rearwardly on frame member 102 into the position shown on side member 12B$^{11}$. The brake block 100 is attached by a resiliently expansible strap. When the orthosis attempts to roll rearwardly in the direction of the arrow against the bias of the strap, the brake block is drawn against the wheel to jam it and thus brake rearward motion. On the other hand, when the orthosis rolls forwardly. No rearward impetus is exerted on the block 100.

Embodiments of the invention in which exclusive property or privilege is claimed, are as follows:

1. A walking support orthosis comprising:

a wheeled frame and a support member for a body brace, the support member being located to extend at least partially behind the body of a user;

a body brace including leg braces having support engagement means to engage said support member, the engagement means being located on a rear part of the body brace, and the leg braces having generally hip level pivotal connections to said support member to allow articulation of the hip joint of the user;

a reciprocating mechanism biasing opposite action of said leg braces.

2. A walking support orthosis comprising:

a wheeled frame and a support member for a body brace, the support member being located to extend at least partially behind the body of a user;

a body brace including leg braces having support engagement means to engage said support, the engagement means being located on a rear part of the body brace, and the leg braces having generally hip level pivotal connections to said support member to allow articulation of the hip joint of the user;

a reciprocating bar mechanism to bias opposite action of said leg braces, the bar mechanism comprising;

a generally horizontal reciprocating bar located behind the body brace and pivotably connected to the wheeled frame for reciprocating movement such that opposing ends of said reciprocating bar move alternatively forwards and rearwards, said leg braces having upward extensions extending upwardly of said pivotal connections, and links between each of said opposing ends of the reciprocating bar and respective ones of said upward extensions whereby movement of one leg of a user in one direction reciprocates said reciprocating bar to bias the other leg of the user in the opposite direction.

3. An orthotic walker as claimed in claim 2 in which each of said links comprises a bar pivotally connected at one end to one of said ends of the reciprocating bar and pivotally connected at an opposite end to one of said upward extension of said leg braces.

4. An orthotic walker as claimed in claim 3 in which the length of each of said links is adjustable.

5. A walking support orthosis comprising:

a wheeled frame;

a support member for a body brace, the support member being located to extend at least partially behind the body of a user;

a body brace including leg braces, and having support engagement means to engage said support member, the engagement means being located on a rear part of the body brace, and the leg braces having generally hip-level pivotal connections to said support member to allow articulation of a hip joint of a user;

a reciprocating strap mechanism biasing opposite action of said leg braces, said strap mechanism comprising a strap connected at opposing ends to a respective leg brace, a bight of the strap extending between said opposing ends and about a fixed part of said frame forward or rearward of the leg braces and distanced therefrom by approximately half the length of the strap.

6. A walking support orthosis as claimed in claim 5 in which said strap mechanism comprises a rear strap having a rearwardly extending bight which passes around a post upstanding from a rear lower frame member.

7. A walking support orthosis as claimed in claim 6 in which each of said opposing ends of the strap is attached to a respective leg brace.

8. A walking support orthosis as claimed in claim 5 in which said strap mechanism comprises a front strap having a forwardly extending bight which passes round a forward lower frame member.

9. A walking support orthosis as claimed in claim 8 in which each of said opposing ends of the front strap is attached to respective leg braces at a lower part of said leg braces.

10. A walking orthosis as claimed in claim 5 also comprising:

a reciprocating bar mechanism biasing opposite action of said leg braces, the bar mechanism comprising;

a generally horizontal reciprocating bar located behind the body brace and pivotably connected to the wheel frame for reciprocating movement such that opposing ends of said reciprocating bar move alternatively forwards and rearwards, said leg braces having upward extensions extending upwardly of said pivotal connections, and links between each of said opposing ends of the reciprocal bar and respective ones of said upward extensions whereby movement of one leg of a user in one direction reciprocates said reciprocating bar to bias the other leg of the user in the opposite direction.

* * * * *